US007278362B2

(12) United States Patent
Hirata et al.

(10) Patent No.: US 7,278,362 B2
(45) Date of Patent: Oct. 9, 2007

(54) PATTERN DATA PRODUCING DEVICE FOR SEWING MACHINE AND PATTERN DATA PRODUCING CONTROL PROGRAM

(75) Inventors: Takashi Hirata, Nagoya (JP); Yuji Iida, Chita (JP); Tomohiko Mori, Inazawa (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 11/196,325

(22) Filed: Aug. 4, 2005

(65) Prior Publication Data

US 2006/0027153 A1 Feb. 9, 2006

(30) Foreign Application Priority Data

Aug. 6, 2004 (JP) ..... 2004-230196

(51) Int. Cl.
*D05B 19/00* (2006.01)

(52) U.S. Cl. ..... 112/470.04; 112/445; 700/138

(58) Field of Classification Search ..... 112/445, 112/458, 470.04, 470.06, 470.01; 700/130, 700/131, 138
See application file for complete search history.

(56) References Cited

U.S. PATENT DOCUMENTS 4,429,364 A * 1/1984 Maruyama et al. ..... 700/137
4,446,520 A * 5/1984 Shigeta et al. ..... 700/137
4,692,871 A * 9/1987 Kinoshita et al. ..... 700/137
4,742,786 A * 5/1988 Hashimoto et al. ..... 112/102.5
4,998,489 A * 3/1991 Hisatake et al. ..... 112/103
5,005,500 A * 4/1991 Kato et al. ..... 112/102.5
5,042,410 A * 8/1991 Nakashima ..... 112/445
5,044,291 A * 9/1991 Kobayashi et al. ..... 112/445
5,099,777 A * 3/1992 Mori ..... 112/445
5,319,565 A * 6/1994 Hausammann et al. ..... 700/131
5,646,861 A * 7/1997 Kotaki ..... 700/138
5,769,013 A * 6/1998 Morita ..... 112/102.5
5,782,189 A * 7/1998 Hirata et al. ..... 112/102.5
5,867,391 A * 2/1999 Muto ..... 700/137
6,430,460 B1 * 8/2002 Taguchi ..... 700/138

FOREIGN PATENT DOCUMENTS

JP 2001-038076 A 2/2001

* cited by examiner

*Primary Examiner*—Gary L. Welch
*Assistant Examiner*—Nathan E Durham
(74) *Attorney, Agent, or Firm*—Oliff & Berridge, PLC

(57) ABSTRACT

A pattern data producing device incorporated in a sewing machine which comprises a sewing mechanism including a needle swing mechanism and a display and in which the sewing mechanism is operated so that a pattern sewing can be carried out, thereby producing pattern data. The pattern data producing device includes a touch panel mounted on an outer surface of the display so as to be capable of detecting a location of touch, a pen-shaped pointing device inputting and instructing on the touch panel a plurality of points corresponding to a plurality of needle drop points forming a pattern, a pattern data producing unit which obtains location data of needle drop points from the input points to produce pattern data, and a display data producing unit which produces, from the location data of needle drop points, display data for displaying a configuration of the pattern on the display.

9 Claims, 14 Drawing Sheets

PATTERN DATA PRODUCING DEVICE FOR SEWING MACHINE AND PATTERN DATA PRODUCING CONTROL PROGRAM

CROSS-REFERENCE TO RELATED APPLICATIONS

This application is based upon and claims the benefit of priority from the prior Japanese Patent Application No. 2004-230196, filed on Aug. 6, 2004, the entire contents of which are incorporated herein by reference.

BACKGROUND

The disclosure relates to sewing machines which comprise a sewing mechanism including a needle swing mechanism and a display and which are capable of performing a pattern sewing by operating the sewing mechanism on the basis of pattern data, and more particularly to a pattern data producing device incorporated in the sewing machines for producing the pattern data and a pattern data producing control program.

Electronically controlled sewing machines have conventionally been provided in which relatively simpler pattern stitches are executable in addition to various utility stitches. In the aforesaid pattern stitches, a control device of the sewing machine reads out pattern data of a desired one of a plurality of patterns selected by a user. The control device controls a sewing mechanism including a needle swing mechanism on the basis of the selected pattern data. In this case, the pattern data are previously stored on a ROM of the control device or are read from an external memory such as a ROM card.

On the other hand, a pattern data producing function has been proposed to be incorporated in electrically controllable sewing machine capable of executing the pattern stitches as described above. The pattern data producing function realizes input of a desired pattern or figure by the user and automatic production of pattern data corresponding to the input pattern. For example, JP-A-2001-38076 discloses a pattern data producing device comprising a large-sized liquid-crystal display provided on a pillar of a sewing machine and including a touch panel mounted on an outer surface of the display.

A pattern input area is displayed on a screen of the display, and cursor moving keys for moving a cursor vertically and laterally and various function keys are set on the touch panel. The user sequentially inputs and instructs a plurality of needle drop points for a desired pattern while operating the cursor moving keys so that the cursor is moved within the pattern input area. Then, pattern data is produced on the basis of data of the input needle drop points.

However, in the above-described conventional pattern data producing device, the cursor needs to be moved to every one of needle drop points so that a plurality of needle drop points are input. Accordingly, since the cursor moving keys need to be operated at a plurality of times in combination, the pattern data producing device is disadvantageous in the operability. Thus, in order that a plurality of needle drop points may be input, the cursor moving keys need to be operated at an increased number of times, whereupon the pattern input necessitates much time.

SUMMARY

Therefore, an object of the disclosure is to provide a pattern data producing device for a sewing machine which can produce pattern data corresponding to a desired pattern input by the user and the operation for input and instruction of needle drop points by the user can be simplified and a pattern data producing control program.

In an embodiment, the disclosure provides a pattern data producing device incorporated in a sewing machine which comprises a sewing mechanism including a needle swing mechanism and a display and in which the sewing mechanism is operated so that a pattern sewing can be carried out, thereby producing pattern data. The pattern data producing device comprises a touch panel provided on an outer surface of the display so as to be capable of detecting a location of touch thereon, a pen-shaped pointing device inputting and instructing on the touch panel a plurality of points corresponding to a plurality of needle drop points forming a pattern, a pattern data producing unit which obtains location data of needle drop points from the input points to produce pattern data, and a display data producing unit which produces, from the location data of needle drop points, display data for displaying a configuration of the pattern on the display.

The user can input and instruct a plurality of points corresponding to a plurality of needle drop points forming a desired pattern respectively, using the pen-shaped pointing device. In this case, since one needle drop point can be input by a single touch operation, input of a plurality of needle drop points can be simplified. Upon input of the needle drop points of the pattern, pattern data is automatically produced from the location data of the needle drop points. Furthermore, display data is automatically produced from the location data of the needle drop points, so that the input pattern can be displayed on the display.

In another embodiment, the touch panel is of a resistive pressure-sensitive analogue detection type. Consequently, the touch panel can be rendered thinner, lightweight and low-cost.

In further another embodiment, the pattern data producing device further comprises a pattern data storage unit which stores the pattern data produced by the pattern data producing unit and a display data storage unit which stores the display data produced by the display data producing unit. Consequently, the pattern data and display data both produced from the input pattern can reliably be stored on the pattern data storage unit and the display data storage unit. When the display data and the pattern data are read out as occasion demands, the pattern can be sewn on the basis of the read pattern data and can further be displayed on the basis of the read pattern data.

In further another embodiment, the pattern data producing device further comprises a display control device which controls the display so that a pattern input screen is displayed on the display, wherein the display control device causes the display to display a pattern input area on the display and a dimensional scale on an outer edge of the pattern input area. Consequently, the size of the pattern to be input by the user can readily be confirmed.

In further another embodiment, the pattern data producing device further comprises a scale-up and scale-down instructing unit which instructs scale-up and scale-down of the pattern input area displayed on the display. Consequently, since pattern input is carried out while the pattern is so sized as to be easy to view for the user, the operability of the pattern data producing device can be improved.

In further another embodiment, the display control device controls the display so that a width of the pattern input area in a needle swing direction is displayed on a reduced scale corresponding to a maximum needle swing width of the needle swing mechanism. Consequently, the user can readily recognize, on the display, the width of the pattern in the needle swing direction.

In further another embodiment, the sewing machine includes a pillar, the display is mounted on the pillar, and the pillar includes a holder holding the pen-shaped pointing device when the pen-shaped pointing device is unused and a lamp lighted or flashed when the pointing device is usable, both the holder and the lamp being located near the display. Consequently, the pen-shaped pointing device can easily be kept in safe, and furthermore, the user can readily know whether the pointing device is usable.

BRIEF DESCRIPTION OF THE DRAWINGS

Other objects, features and advantages of the disclosure will become clear upon reviewing the following description of the embodiment with reference to the accompanying drawings, in which.

DETAILED DESCRIPTION OF EMBODIMENTS

Figure 1:
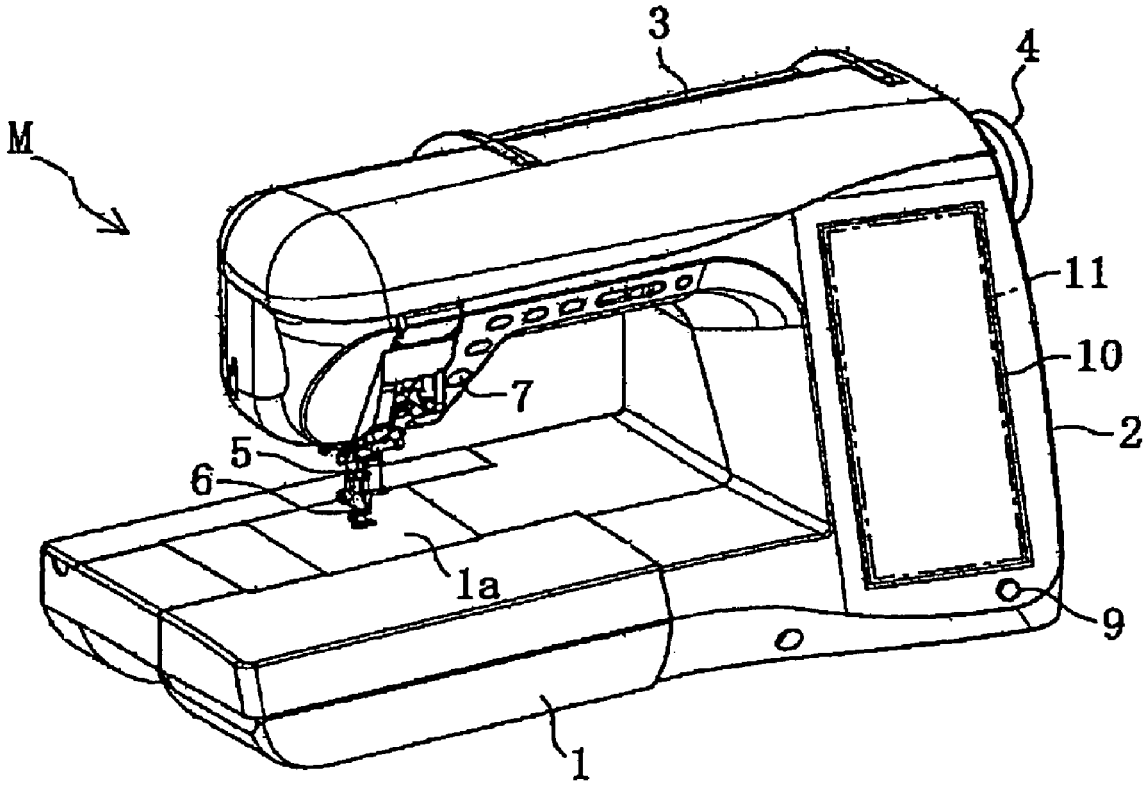
FIG. 1 is a perspective view of an electronically controlled sewing machine incorporated with a pattern data producing device of an embodiment in accordance with the disclosure.
Figure 2:
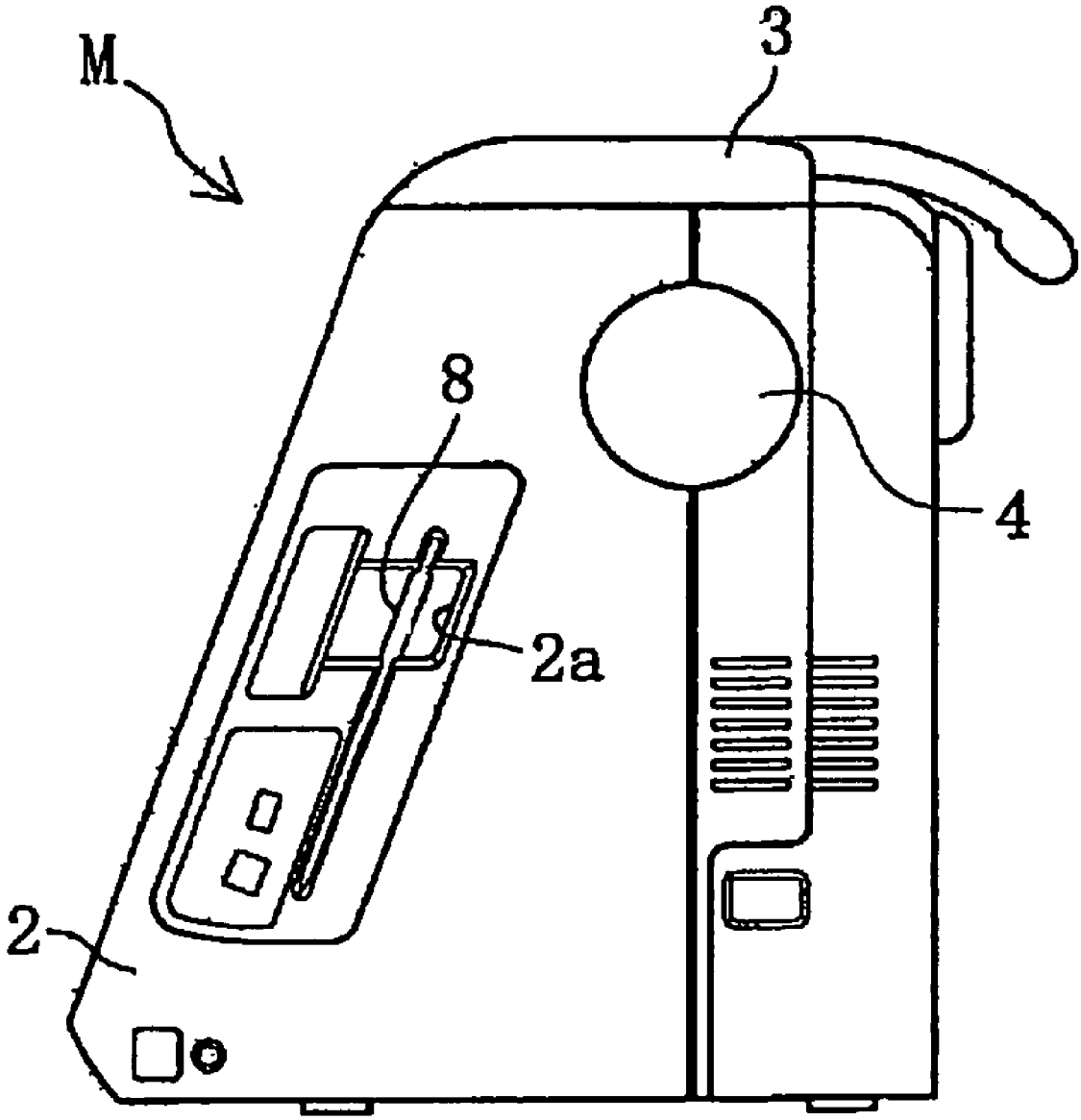
FIG. 2 is a right side view of the sewing machine.

An embodiment of the disclosure will be described with reference to the accompanying drawings. Referring to FIG. 1, a sewing machine (an electronically controlled sewing machine) is shown in which an embroidery data producing device of the embodiment is incorporated. The sewing machine M includes a body further including a sewing bed 1, a pillar standing upright from a right end of the bed 1 and a sewing arm 3 extending leftward from an upper end of the pillar 2, the latter three being integral with the body of the sewing machine M.

The arm 3 has a lower distal end on which a needle bar 5 having a sewing needle 6 is mounted. A needle plate 1*a* is mounted on an upper surface of the bed 1 so as to correspond to the needle bar 5. In the bed 1 are provided a feed dog vertically moving mechanism for vertically moving a feed dog and a feed dog laterally moving mechanism for laterally moving the feed dog, a rotary hook accommodating a bobbin and forming stitches in cooperation with the needle 6, a thread cutting mechanism and the like.

Figure 3:
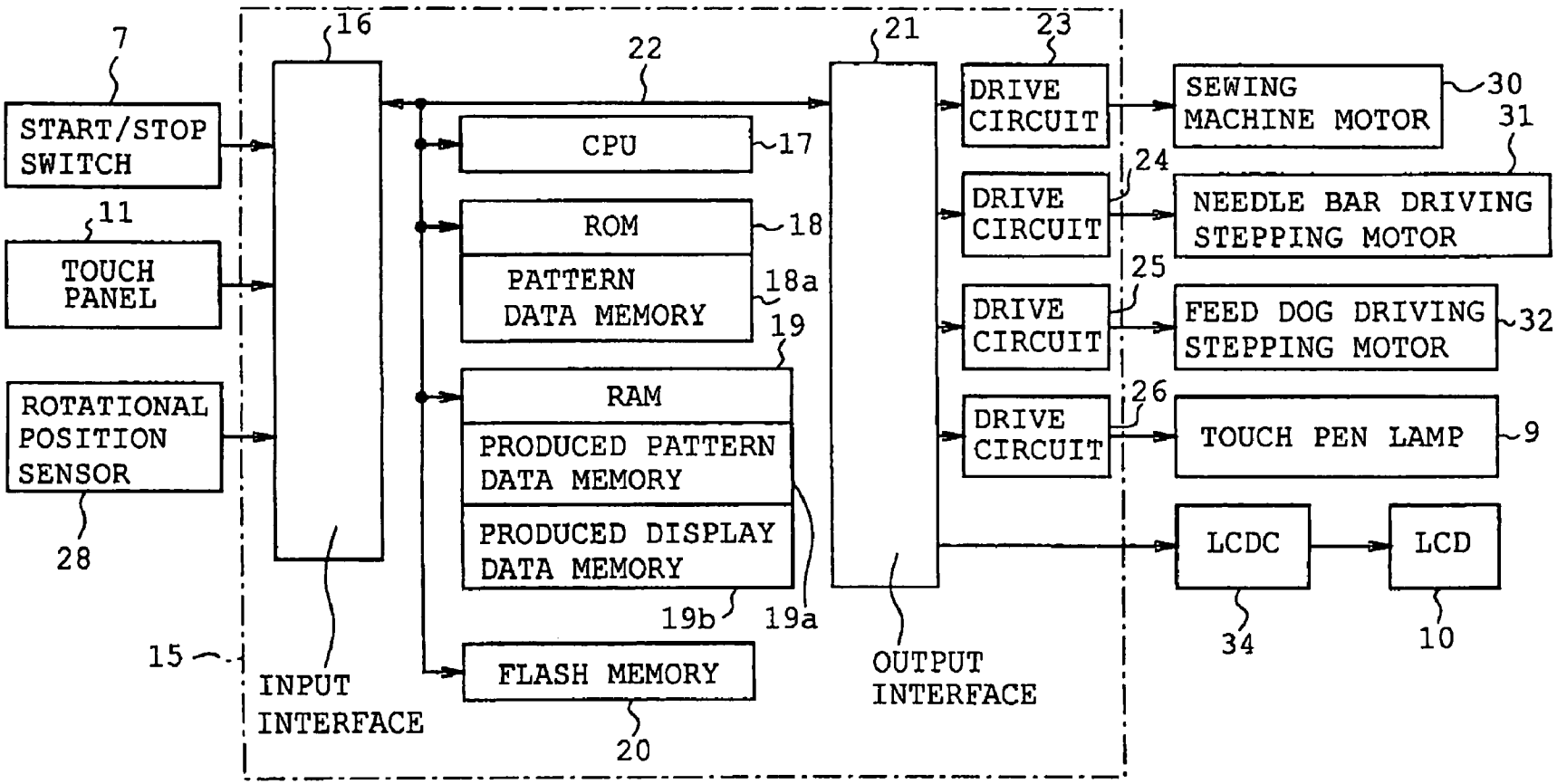
FIG. 3 is a block diagram showing an electrical arrangement of a control system of the sewing machine.

A sewing machine main shaft (not shown) extending laterally is mounted in the arm 3 so as to be rotated by a sewing machine motor 30 (see FIG. 3). The arm 3 has a right side on which a hand pulley 4 is mounted to be manually operated so that the sewing machine main shaft is manually rotated. In the arm 3 are provided a needle bar driving mechanism for vertically moving the needle bar 5, a needle bar swinging mechanism (needle swing mechanism) for swinging the needle bar 5 in a direction (a lateral direction) perpendicular to a cloth feed direction and a thread take-up lever driving mechanism for vertically moving the thread take-up lever in synchronization with a vertical movement of the needle bar 5. On a front of the arm 3 are mounted a start/stop switch 7 for starting and stopping a sewing operation and other switches. In this case, the feed dog vertically moving mechanism and the needle bar vertically moving mechanism is driven in synchronism with the main shaft rotated by the sewing machine motor 30. Furthermore, the needle bar swinging mechanism is driven by a needle bar swinging stepping motor 31 (see FIG. 3), whereas the feed dog laterally moving mechanism is driven by a feed dog laterally moving mechanism 32 (see FIG. 3).

The above-described mechanisms constitute a sewing mechanism executing a sewing operation for work cloth. Utility stitches such as straight stitches or zigzag stitches are carried out in combination of cloth feed and needle swing, and a pattern sewing can be carried out on the basis of previously stored pattern data. In this case, as will be described in detail, the sewing machine M is provided with a pattern data producing function of inputting data of configuration of any pattern by the user and producing pattern data of the input pattern (a pattern data producing device).

A large-sized vertically long liquid-crystal display (LCD) 10 is mounted on the front side of the pillar 2 as shown in FIG. 1. The display 10 is capable of displaying images in colors. The display 10 can display various stitch patterns of utility stitches, names of various functions necessary for a sewing work, various messages and the like.

Figure 10:
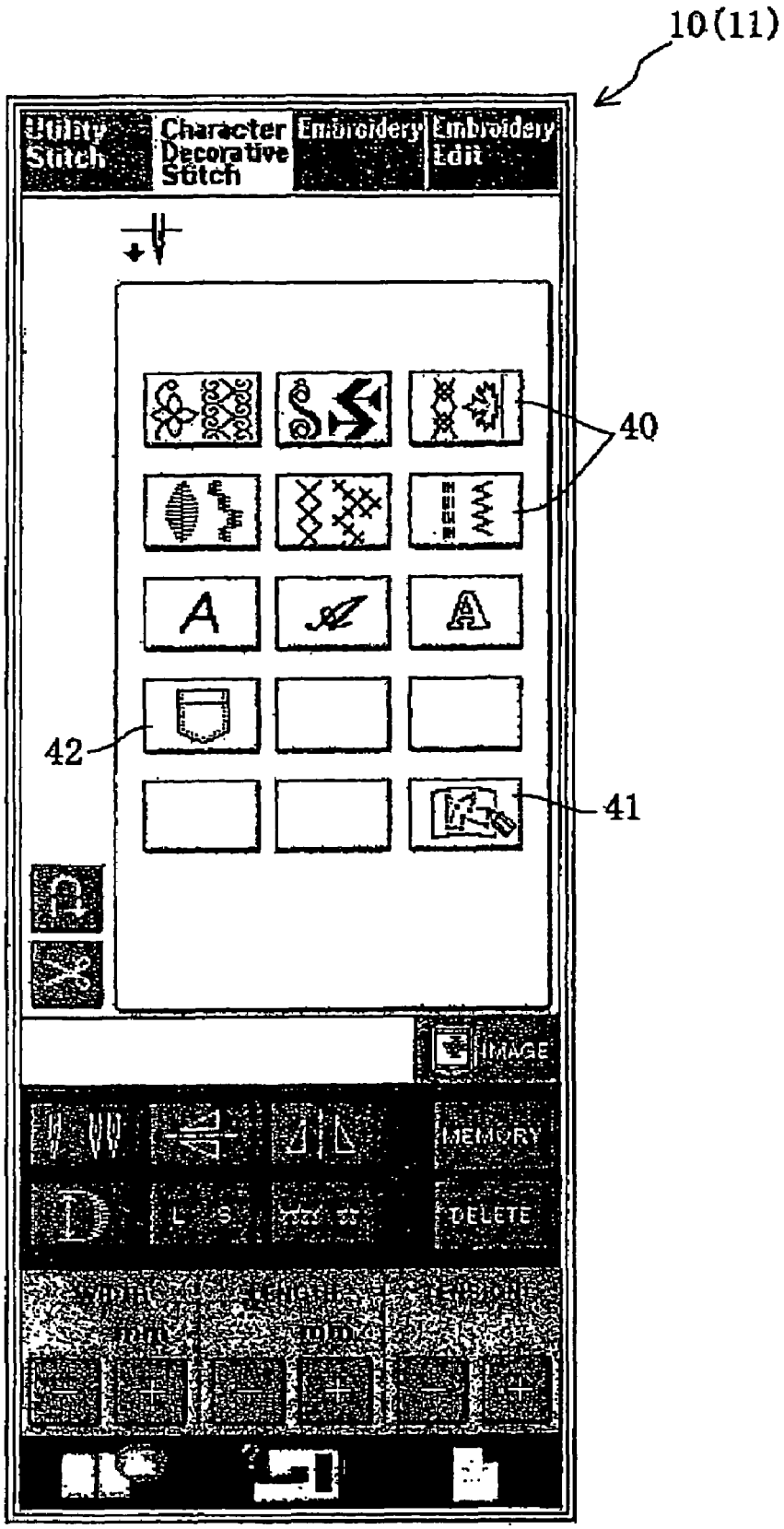
FIG. 10 illustrates an example of menu screen.

FIG. 10 shows an example of menu screen displayed on the display 10. The menu screen displays a plurality of pattern keys 40 for selecting a plurality of patterns (figure patterns and character patterns), a my-illustration producing key 41, a produced pattern read-out key 42 reading out pattern data already produced and stored on a flash memory 20 and a plurality of other function keys. When the user inputs a desired pattern using the pattern data producing function, a pattern input screen (a my-illustration producing screen is displayed as shown in FIGS. 11 to 15. The my-illustration producing screen will be described in detail later.

A touch panel 11 is mounted on the surface of the display 10. The touch panel 11 is a transparent touch panel of a resistive pressure-sensitive analog detection type and is capable of detecting a touch location the user touches the screen with his or her finger or a pen-type pointing device. As a result, patterns to be used for the sewing by the user can be selected and various functions can be instructed, and furthermore, the user can input points corresponding to a plurality of needle drop points forming any pattern, as will be described later.

The touch panel 11 of the resistive pressure-sensitive analog detection type will be described in brief. The touch panel 11 comprises a thin film or glass base material and upper and lower electrodes formed by arranging resistors crisscross and then affixing the resistors to a film by printing or deposition. The upper and lower electrodes are disposed oppositely. When the touch panel 11 is depressed by a finger, a pen etc., a location of depression is detected on the basis of voltage at a location conducting due to the depression. The touch panel 11 of the resistive pressure-sensitive analog detection type is thin and lightweight and furthermore low-cost.

Furthermore, in the embodiment, a touch pen 8 serving as a pen-shaped pointing device is attached to the sewing machine M. A holder 2*a* formed into a vertically long recess is formed in a side of the pillar 2. The touch pen 8 is held in the holder 2*a* when not used. The user can insert the touch pen 8 into the holder 2*a* so that the touch pen 8 is kept in safe. In use, the user holds the touch pen 8 between his or her fingers so that the touch pen 8 can easily be detached from the holder 2*a*. Additionally, a touch-pen lamp 9 comprising an LED is provided below the display 10. The touch-pen lamp 9 is adapted to be turned on only when the touch pen 8 is usable.

The control system of the sewing machine M will be described with reference to FIG. 3. The sewing machine M includes a control device 15 mainly composed of a microcomputer and controlling the whole sewing machine M. The control device 15 includes an input interface 16, a ROM 18, a RAM 19, an electrically rewritable non-volatile flash memory 20 and an output interface 21 all of which are connected to one another by a bus 22. Drive circuits 23 to 26 are connected to the output interface 21.

The flash memory 20 is adapted to store pattern data and display data both produced by a pattern data producing control as will be described later, for every pattern. To the input interface 16 are connected the start/stop switch 7, touch panel 11, a rotational position sensor 28 detecting a rotational position of the main shaft and the like. To the output interface 21 are connected the drive circuits 23 to 25 driving the aforesaid motors 30 to 32 respectively, a drive circuit 26 driving the touch pen lamp 9, a liquid crystal display controller (LCDC) 34 and the like.

The ROM 18 previously stores a sewing control program for controlling the sewing mechanism for execution of a sewing operation, a display control program including display control for the display 10, a pattern data producing control program which will be described later, and the like. The ROM 18 is provided with a pattern data memory 18*a* which stores, for every pattern, sewing data for carrying out utility stitches, pattern data for carrying out pattern sewing for a previously stored plurality of patterns and display data for the patterns.

The RAM 19 is provided with a sewing pattern data memory reading in and storing pattern data used for sewing, various memories storing results of computation executed by the CPU 17, pointers, counters and the like. The RAM 19 is further provided with a produced pattern data memory 19*a* temporarily storing pattern data produced by a pattern data producing control as will be described later and a produced display data memory 19*b* temporarily storing display data produced from the pattern data.

The control device 15 carries out the pattern data producing control program stored on the ROM 18, thereby executing processing for the pattern data producing control (a my-illustration producing mode) for producing pattern data on the basis of input of any pattern by the user. In this pattern data producing control (the my-illustration mode) are carried out an input data accepting routine, a pattern data producing routine, a display data producing routine, a display control routine and the like. In the input data accepting routine, instructions input by the user with the touch pen 8 are accepted. More specifically, instructions are input onto the touch panel 11 provided on the surface of the display 10 in the form of a plurality of points corresponding to a plurality of needle drop points forming any pattern. These instructions are accepted, whereby data of input points is taken in.

In the above-noted pattern data producing routine, location data of needle drop points is obtained from the input points, whereby pattern data is produced. In the display data producing routine, display data for displaying a pattern configuration on the display 10 is produced from the aforesaid location data of needle drop points. In the display control routine, a screen (the my-illustration screen) for pattern input is displayed on the display 10. Accordingly, the control device 15 serves as a pattern data producing unit, a display data producing unit and a display control unit.

In the embodiment, as shown in FIGS. 11 to 15, a pattern input area (a campus 50) is displayed on the display 10, and a dimensional scale is displayed on an outer edge of the campus 50. In this case, a width of the campus 50 in a needle swing direction (lateral direction) is displayed on a reduced scale corresponding to a width of the needle bar swinging mechanism by which the needle can be swung. Furthermore, a scale-up key 66 and a scale-down key 67 for instructing scale-up and scale-down of the campus 50 are displayed (set) on the my-illustration screen. When scale-up or scale-down display has been instructed, the campus 50 displayed is scaled up or down in comply with the instruction.

Figure 4A:
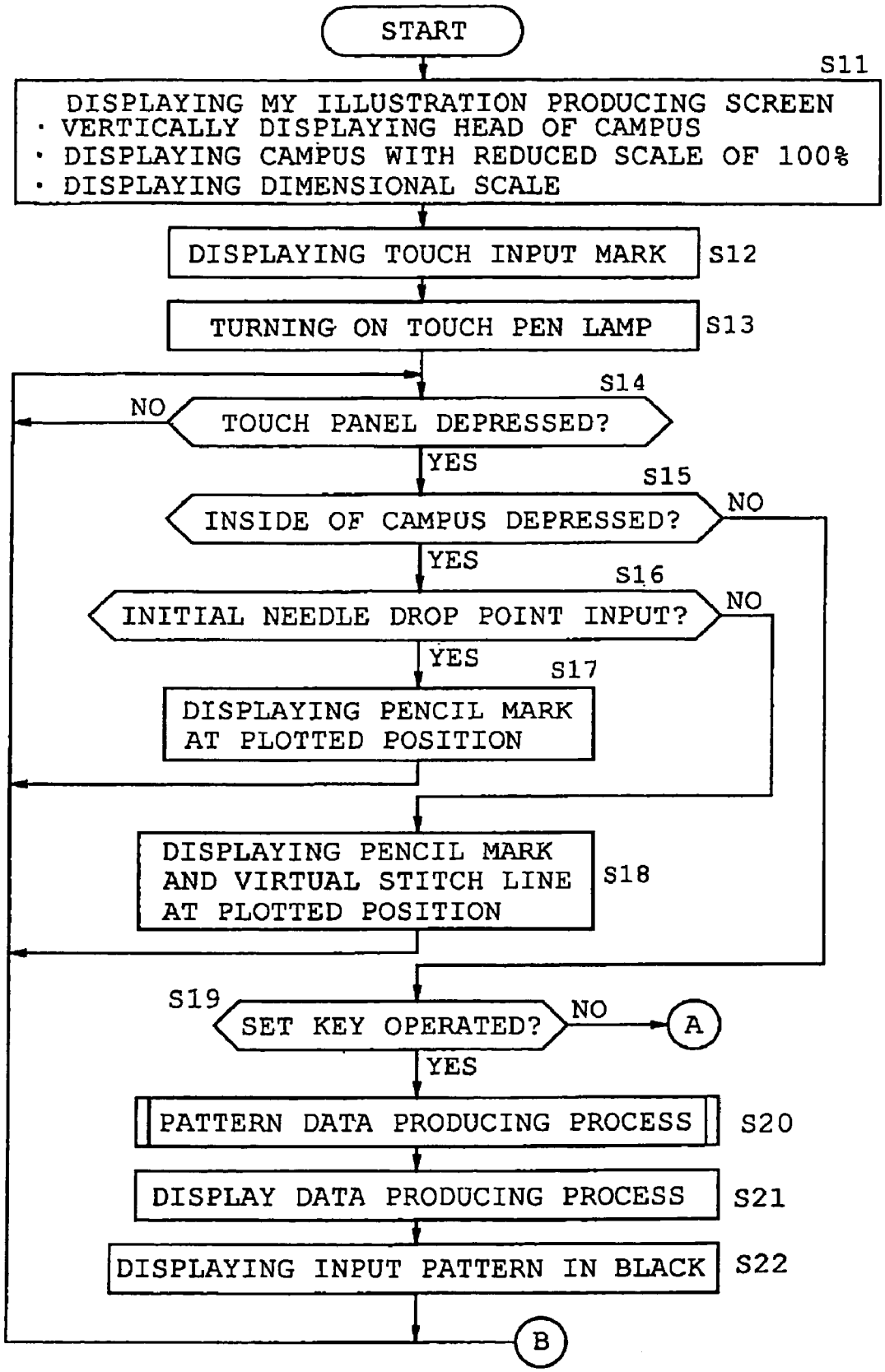
FIGS. 4A and 4B are flowcharts showing an entire procedure of the pattern data producing control.
Figure 4B:
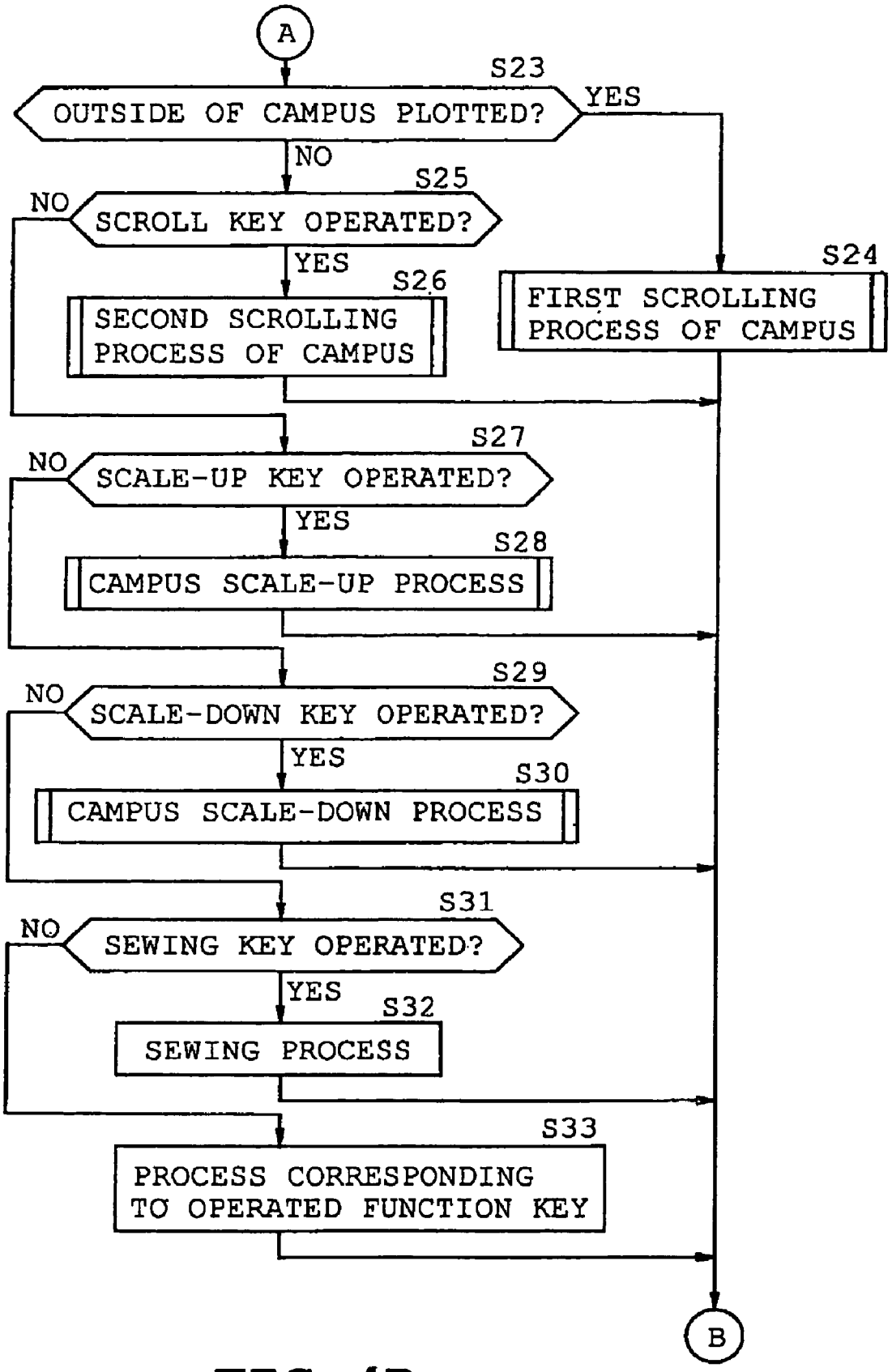

The operation of the sewing machine M will be described with reference to FIGS. 4A to 15. FIGS. 4A and 4B are flowcharts showing an entire procedure of the pattern data producing control carried out by the control device 15. FIGS. 5 to 9 are flowcharts showing the steps S20, S24, S26, S28 and S30 in FIGS. 4A and 4B in detail respectively. In each figure, steps are designated by reference symbol Si where i=11, 12, 13 and . . . .

Figure 11:
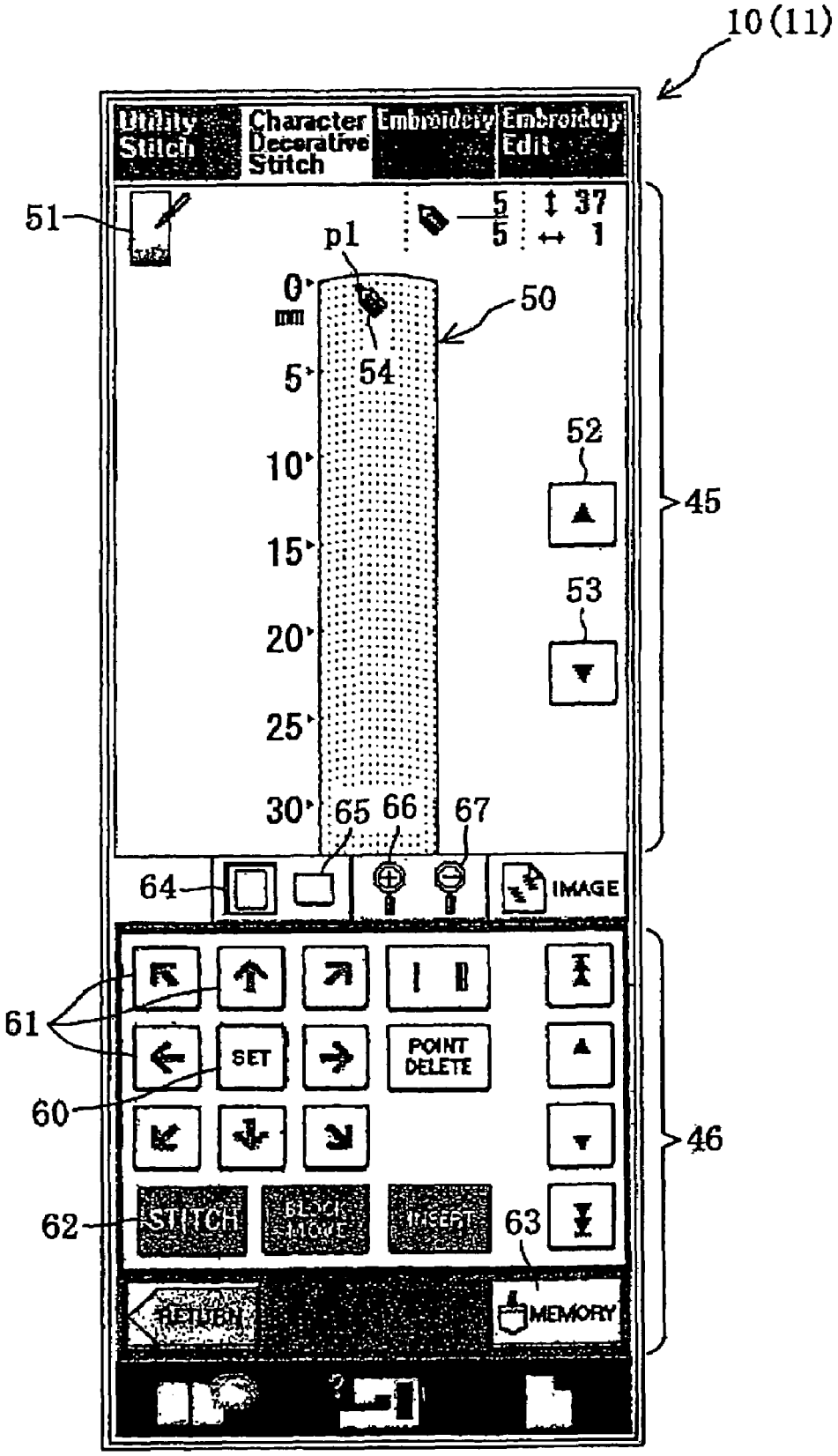
FIG. 11 illustrates an example of my-illustration producing screen.

When wishing to produce new pattern data of any pattern, the user touches the my-illustration key 41 while a menu screen as shown in FIG. 10 is displayed on the display 10. Then, the my-illustration producing mode is set and the processing of pattern data producing control as shown in the flowcharts of FIGS. 4A and 4B is started. More specifically, upon start of the pattern data producing control, the phrase, "my illustration producing screen" is displayed on the display 10 (S11). In the my-illustration producing screen, as shown in FIG. 11, a pattern producing area 45 is displayed on an upper part of the screen, whereas a function commanding area 46 for commanding various functions is displayed on a lower part of the screen. The campus 50 is displayed as a pattern input area in the pattern producing area 45. In this case, the direction of the campus 50 to be displayed can be specified by a vertical or horizontal display key 64 or 65. In the initial state, a vertical display mode is automatically set as in the case where the vertical display key 64 has been operated. A set key 60, eight-way cursor movement keys 61, a sewing key 62, a preserve key 63 and the like are set in the function commanding area 46.

A slender band-shaped head of the campus 50 is displayed in the vertically directed state in the pattern producing area 45. The head is displayed with a reduced scale of 100%. A dimensional scale (0 mm, 5 mm, 10 mm, 15 mm, 20 mm and . . . ) is displayed on an outer edge of the campus 50 in the unit of 5 mm. In this case, a width of the campus 50 in the needle swing direction (the lateral direction in FIG. 11) is displayed on a reduced scale corresponding to a width of the needle swinging mechanism by which the needle can be swung. Upper and lower scroll keys 52 and 53 are simultaneously displayed in the pattern producing area 45.

Next, a touch input mark 51 is displayed in an upper left corner of the pattern producing area 45 (S12). The touch input mark 51 informs the user that needle drop points can be input using the touch pen 8. With this, the touch pen lamp 9 provided on the pillar 2 of the sewing machine M is turned on (S13). Accordingly, based on the displayed touch input mark 51 and turn-on of the touch pen lamp 9, the user can readily recognize that needle drop points of the pattern can be input using the touch pen 8. Then, the user detaches the touch pen 8 from the pen holder 2*a* and can input (plot) the points corresponding to the needle drop points of the desired pattern in the campus 50 using the touch pen B.

When an inside of the campus 50 is depressed by the touch pen 8 (S14: YES, S15: YES), it is determined whether an initial needle drop point p1 has been input (S16). When the initial needle drop point p1 has been input and instructed (S16: YES), a pencil mark 54 having a marking function is displayed at a plot position inside the campus 50 corresponding to a portion depressed by the touch pen 8 (S17). The control device 15 then returns to step S14. As shown in FIG. 11, for example, the pencil mark 54 is displayed so as to indicate the input initial needle drop point p1 by a distal end thereof. The user confirms the needle drop point on the display 10 every time one needle drop point is input. Upon confirmation, the user depresses the set key 60. When the set key 60 has been turned on (S19: YES), the input location of the needle drop point is decided and continuously, the pattern data producing process is carried out (S20).

Figure 5:
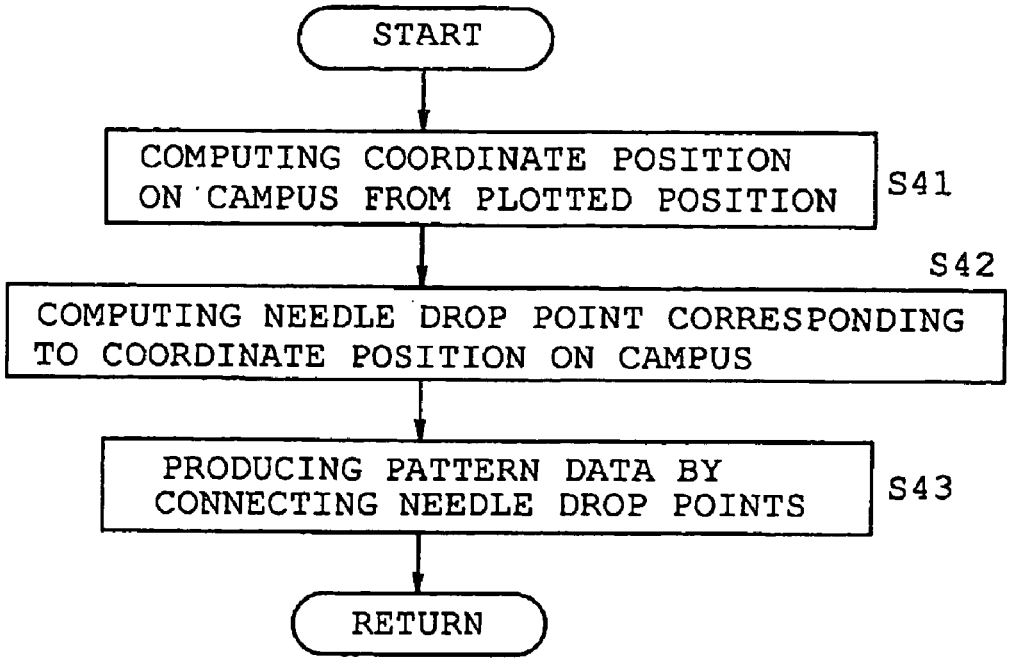
FIG. 5 is a flowchart showing a procedure of pattern data producing procedure.

FIG. 5 is a flowchart showing a detailed procedure of the pattern data producing process. Firstly, a coordinate position on the campus 50 is obtained by computation from the plot location inside the campus 50 (S41). An origin on the campus 50 is located at an upper left of the campus 50 and moreover, corresponds to an origin in the sewing process. Subsequently, a needle drop point (a sewing start position) corresponding to the coordinate position on the campus 50 is obtained by computation (S42) Finally, pattern data is produced by connecting the needle drop points and stored on the produced pattern data memory 19*a* (S43). The control device 15 then returns to the pattern data producing control (see FIGS. 4A and 4B).

Returning to FIGS. 4A and 4B, upon completion of the pattern data producing process (S20), display data is produced on the basis of the pattern data stored on the produced pattern data memory 19*a* or from the produced position data of needle drop points (S21). The display data is provided for displaying the input pattern on the display 10. Then, stitch lines of the input pattern are displayed in black (S22) and thereafter, the control device 15 returns to step S14. Only the needle drop point p1 is displayed in black when the initial needle drop point p1 is input.

Figure 12:
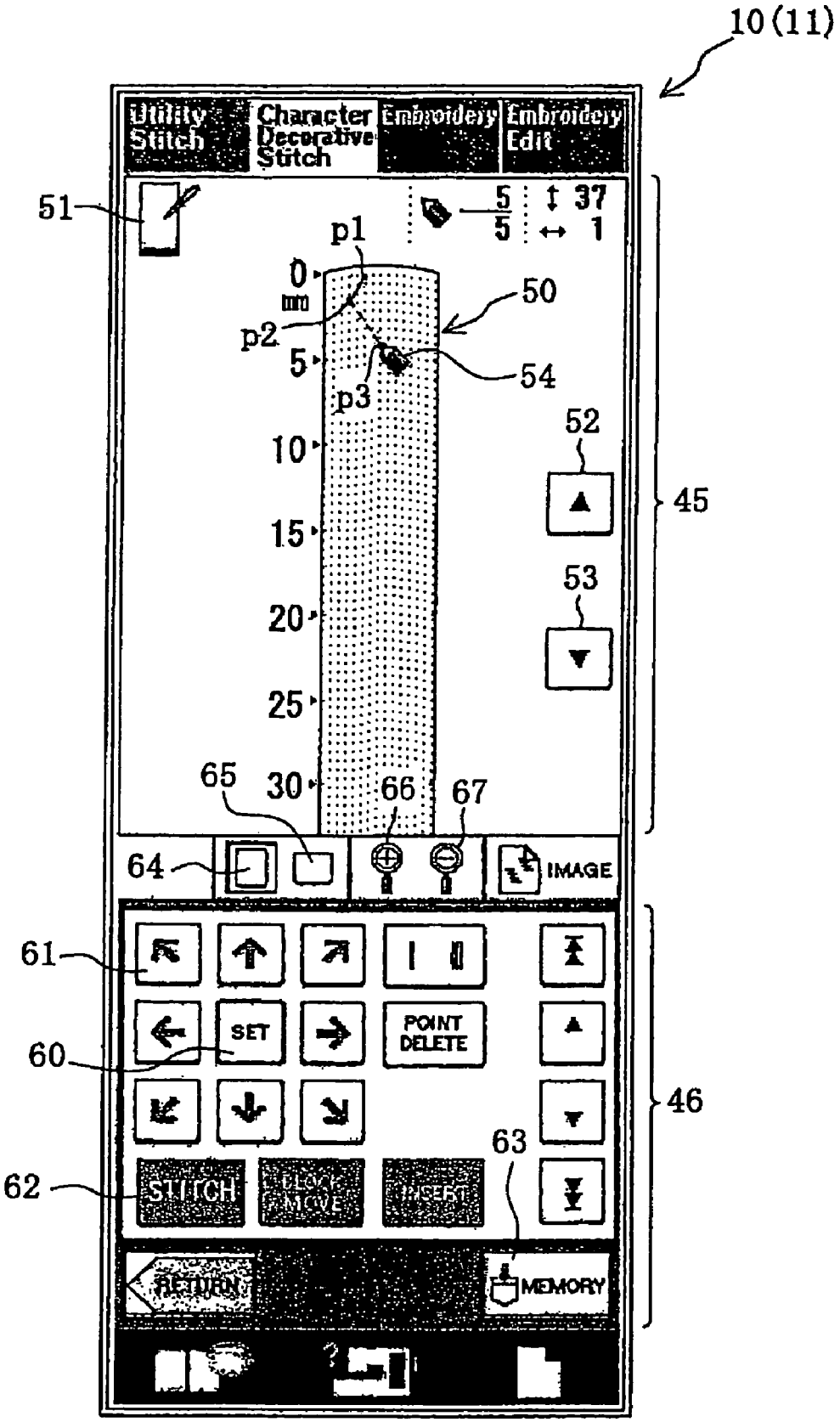
FIG. 12 illustrates my-illustration producing screen during input of a pattern.

When the touch pen 8 is operated so that second and subsequent needle drop points (p2, p3 and . . . ) are depressed inside the campus 50 (S14: YES, S15: YES, S16: NO), the pencil marks 54 are displayed at the plot positions respectively, and a virtual linear stitch line extending from the last needle drop point to the current plot position is displayed in red (S18). When the user then inputs a second needle drop point p2, a stitch line of the input pattern from the needle drop point p1 to the second needle drop point p2 is displayed in red. When the user operates the set key 60 in this state, pattern data up to the second needle drop point p2 is produced and stored, and a stitch line of the input pattern from the needle drop point p1 to the second needle drop point p2 is displayed in black within the campus 50. Subsequently, as shown in FIG. 12, when the user inputs a third needle drop point p3, for example, a stitch line of the input pattern from the needle drop point p2 to the third needle drop point p3 is displayed in red (shown by dot line for convenience). Thus, the user inputs needle drop points sequentially in the manner as described above, so that pattern data of a desired pattern is produced.

Figure 6:
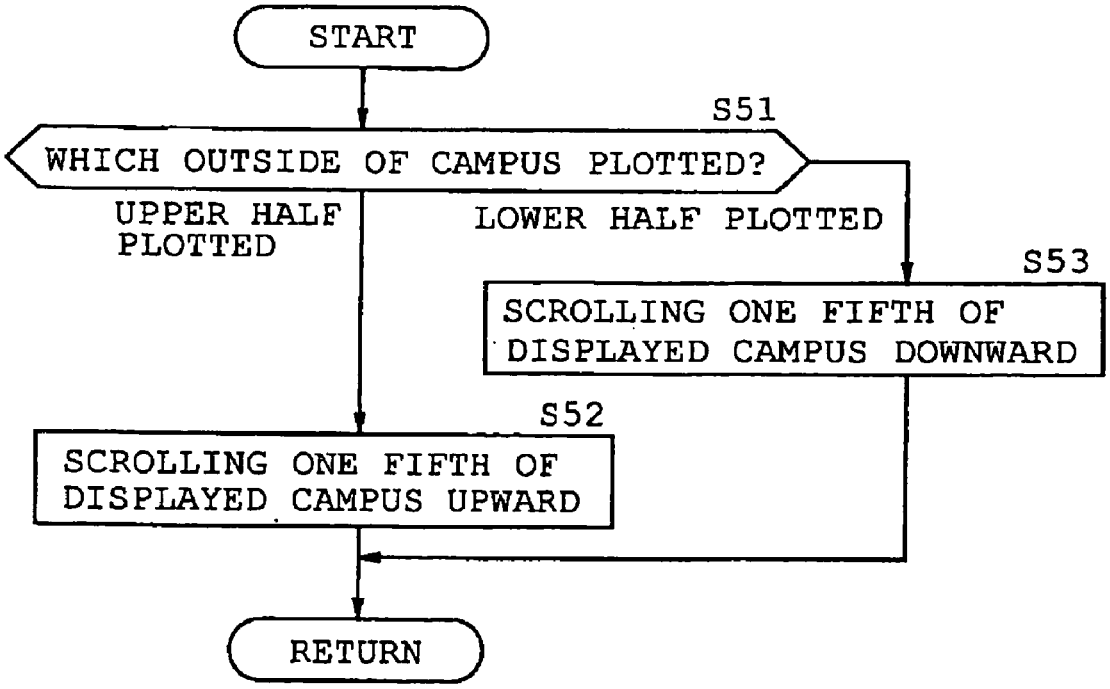
FIG. 6 is a flowchart showing of a first scroll process of a campus.

On the other hand, when the user would like to input needle drop points regarding an elongate pattern, there is a possibility that the campus 50 currently displayed on the display 10 may be short of the length. In view of this problem, the user can scroll the displayed campus 50. Now, when an outside (a blank other than keys) of the campus 50 within the pattern producing area 45 is plotted during processing in the pattern data producing control (S23: YES), a first scrolling process of the campus 50 is carried out (S24). FIG. 6 is a flowchart showing detailed procedures of the first scrolling process. More specifically, firstly, it is determined whether the plotted position is in an upper or lower half of the pattern producing area 45 (S51). When the plotted position belongs substantially to the upper half of the pattern producing area 45, the campus 50 is scrolled upward (S52). In this case, the length of scroll per case is set at about one fifth of the length of the campus 50 (about 5 mm, for example).

Figure 13:
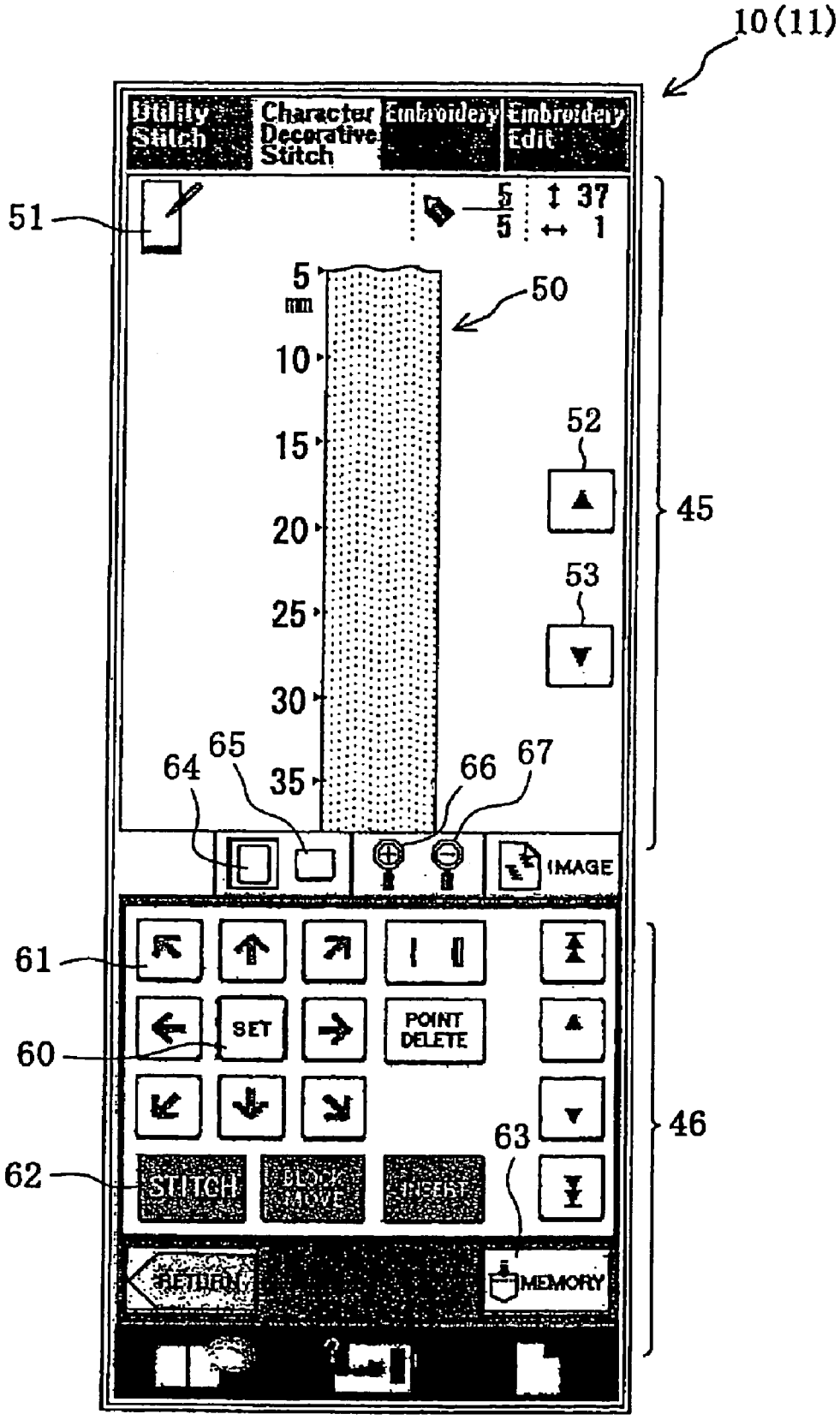
FIG. 13 illustrates my-illustration producing screen during scrolling.

FIG. 13 shows the upwardly scrolled campus 50. On the other hand, when the plotted position belongs substantially to the lower half of the pattern producing area 45, the campus 50 is scrolled downward by the length equal to about one fifth of the length of the campus 50 (S53). Upon completion of the first scrolling process, the control device 15 returns to the pattern data producing control (step S14 in FIG. 4A).

Figure 7:
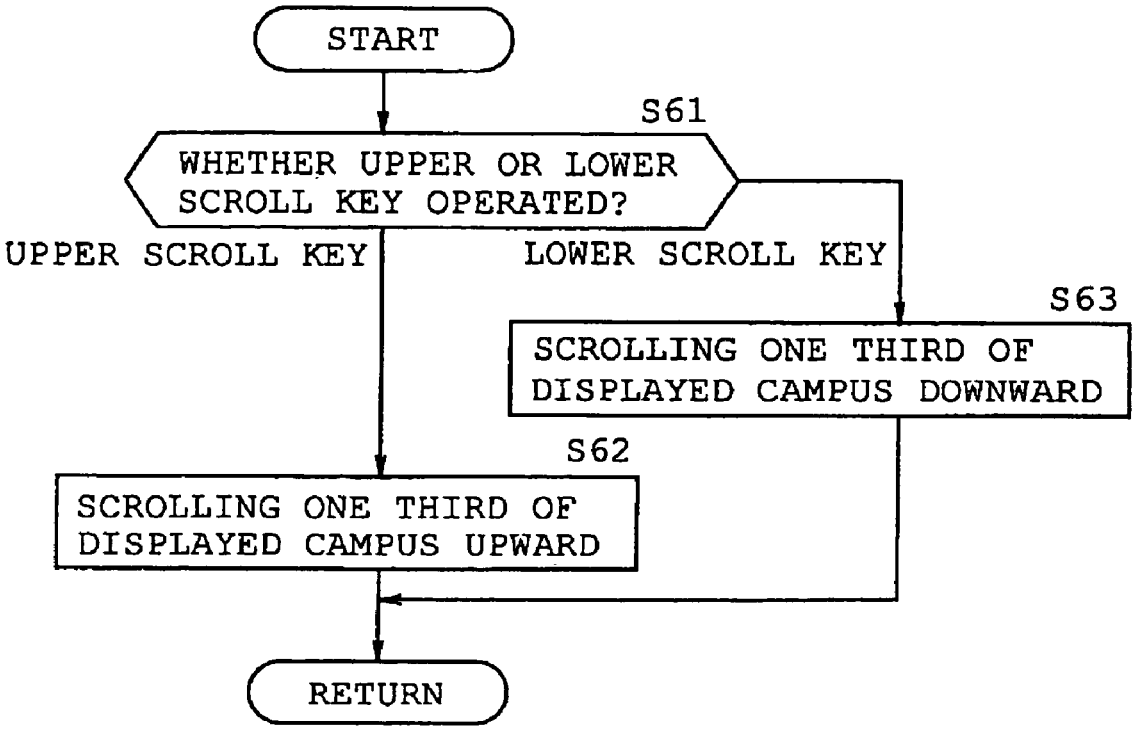
FIG. 7 is a flowchart showing of a second scroll process of the campus.

Furthermore, when the scroll keys 52 and 53 displayed within the pattern producing area 45 are depressed (S25: YES), a second scrolling process of the campus 50 is carried out (S26). FIG. 7 is a flowchart showing detailed procedures of the second scrolling process. More specifically, firstly, it is determined whether the upper or lower scroll key 52 or 53 has been operated (S61). When the upper scroll key 52 has been operated, the displayed campus 50 is scrolled upward (S62). In this case, the scroll length per case is set at about one third of the length of the campus 50. When the lower scroll key 53 has been operated, the displayed campus 50 is scrolled downward by the length equal to about one third of the length of the campus 50 (S63). Upon completion of the second scrolling process, the control device 15 returns to the pattern data producing control (step S14 in FIG. 4A). Thus, the user can input data of an elongate pattern while scrolling the campus 50 by each scrolling process.

Figure 8:
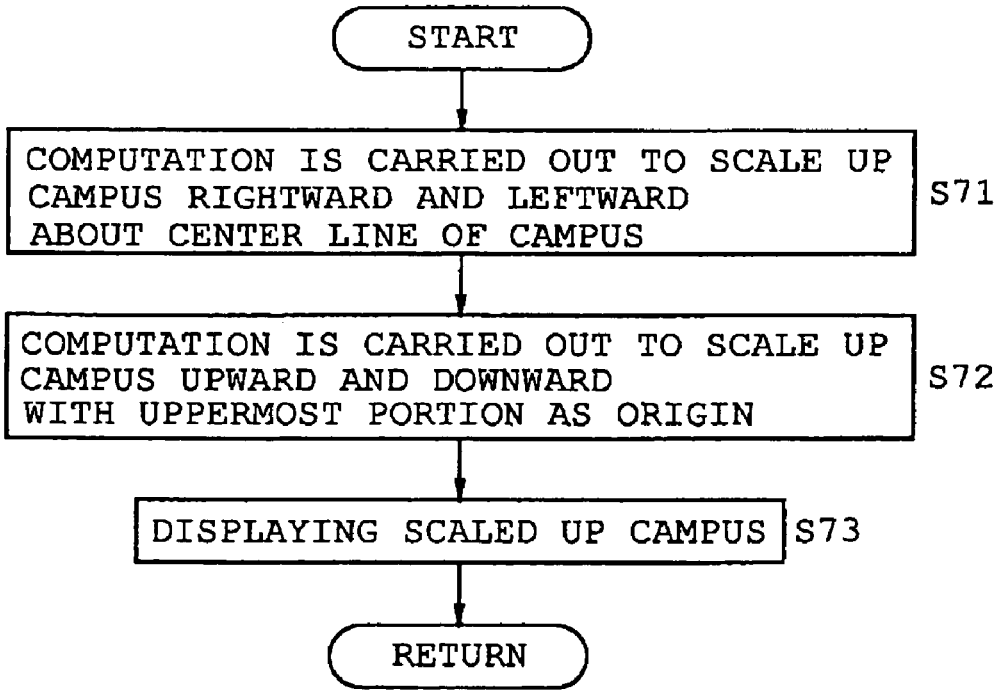
FIG. 8 is a flowchart showing a scale-up process of the campus.

In the embodiment, the campus 50 displayed within the pattern producing area 45 can be scaled up or down by the user. More specifically, when a scale-up key 66 set on the touch panel 11 has been depressed (S27: YES), a process of scaling up the campus 50 is carried out (S28). FIG. 8 is a flowchart showing detailed procedures of the campus scale-up process. More specifically, firstly, computation is carried out to scale up the campus 50 rightward and leftward about a center line of the campus 50 (S71). Subsequently, computation is also carried out to scale up the campus 50 upward and downward with the uppermost portion thereof as an origin (S72). Finally, the scaled up campus 50 is displayed in the pattern producing area 45 (S73). Upon completion of the campus scaling up process, the control device 15 returns to the pattern data producing control (step S14 in FIG. 4A).

Figure 9:
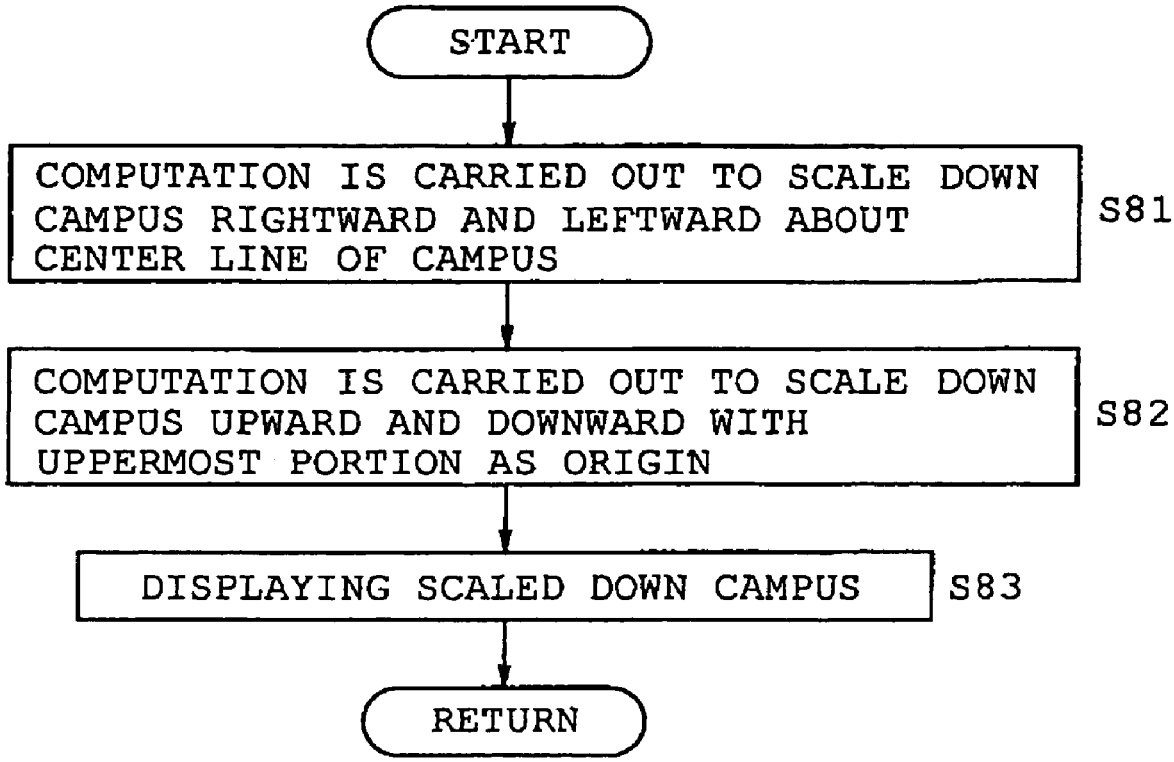
FIG. 9 is a flowchart showing a scale-down process of the campus.

On the other hand, when a scale-down key 67 serving as a scale-down instruction input section has been depressed (S29: YES), a process of scaling down the campus 50 is carried out (S30). FIG. 9 is a flowchart showing detailed procedures of the campus scale-down process. More specifically, firstly, computation is carried out to scale down the campus 50 rightward and leftward about a center line of the campus 50 (S81). Subsequently, computation is also carried out to scale down the campus 50 upward and downward with the uppermost portion thereof as an origin (S82). Finally, the scaled down campus 50 is displayed in the pattern producing area 45 (S83). Upon completion of the campus scale-down process, the control device 15 returns to the pattern data producing control (step S14 in FIG. 4A).

Figure 14:
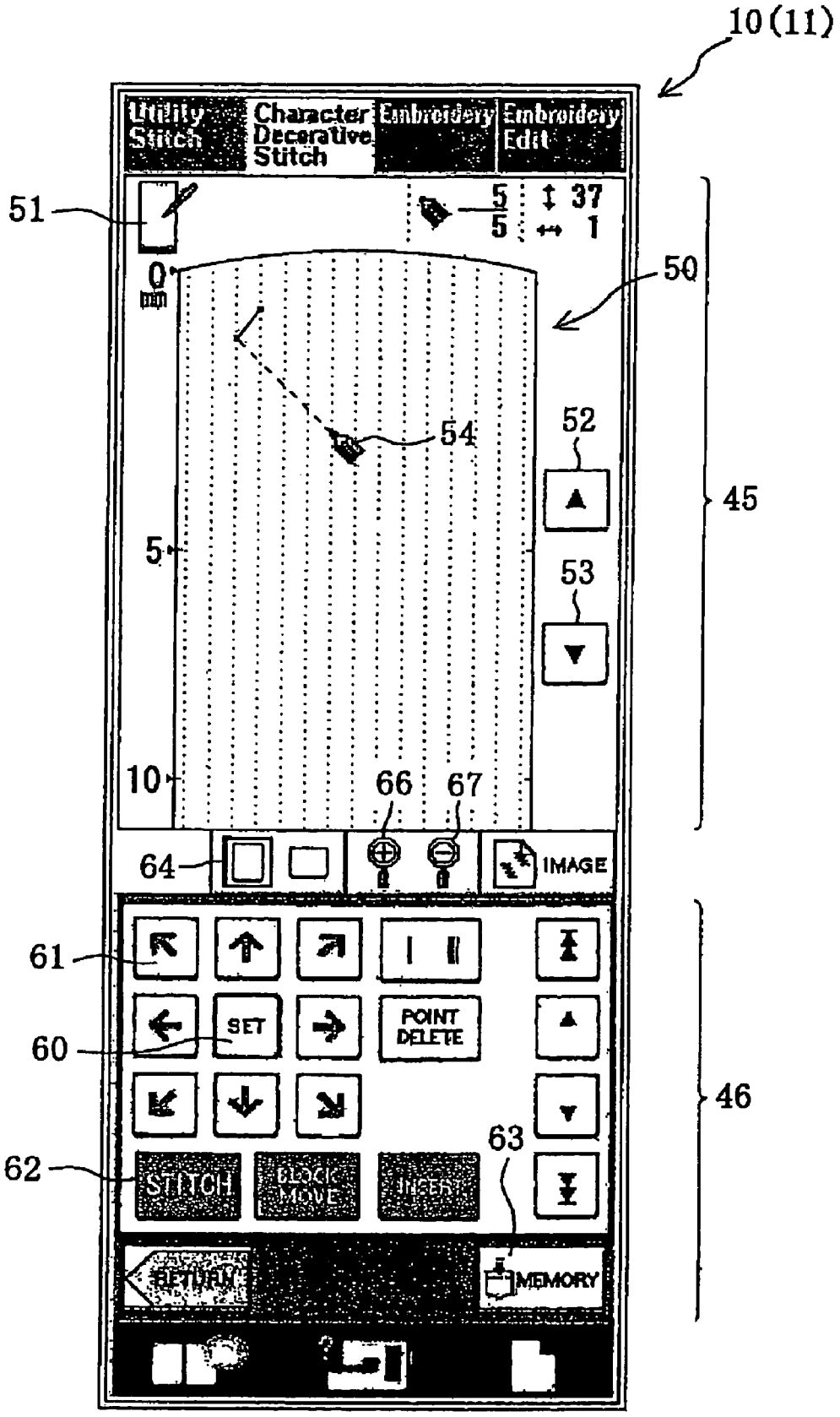
FIG. 14 illustrates the scaled-up campus in my-illustration producing screen.

For example, when the scale-up key 66 is operated during pattern production as shown in FIG. 12, a displayable part of the scaled up campus 50 scaled up laterally and vertically is displayed on the pattern producing area 45 as shown in FIG. 14. Thus, when the campus 50 is scaled up or down, the campus 50 can be displayed with such a size that the user can easily view the campus 50 and input the needle drop points.

A sewing process is carried out (S32) when the sewing key 62 is depressed after input of all the needle drop points for the pattern has been completed (S31: YES). In the sewing process, the sewing mechanism is controlled on the basis of the produced pattern data stored on the produced pattern data memory 19*a*, so that pattern sewing is carried out for the pattern produced by the user.

Figure 15:
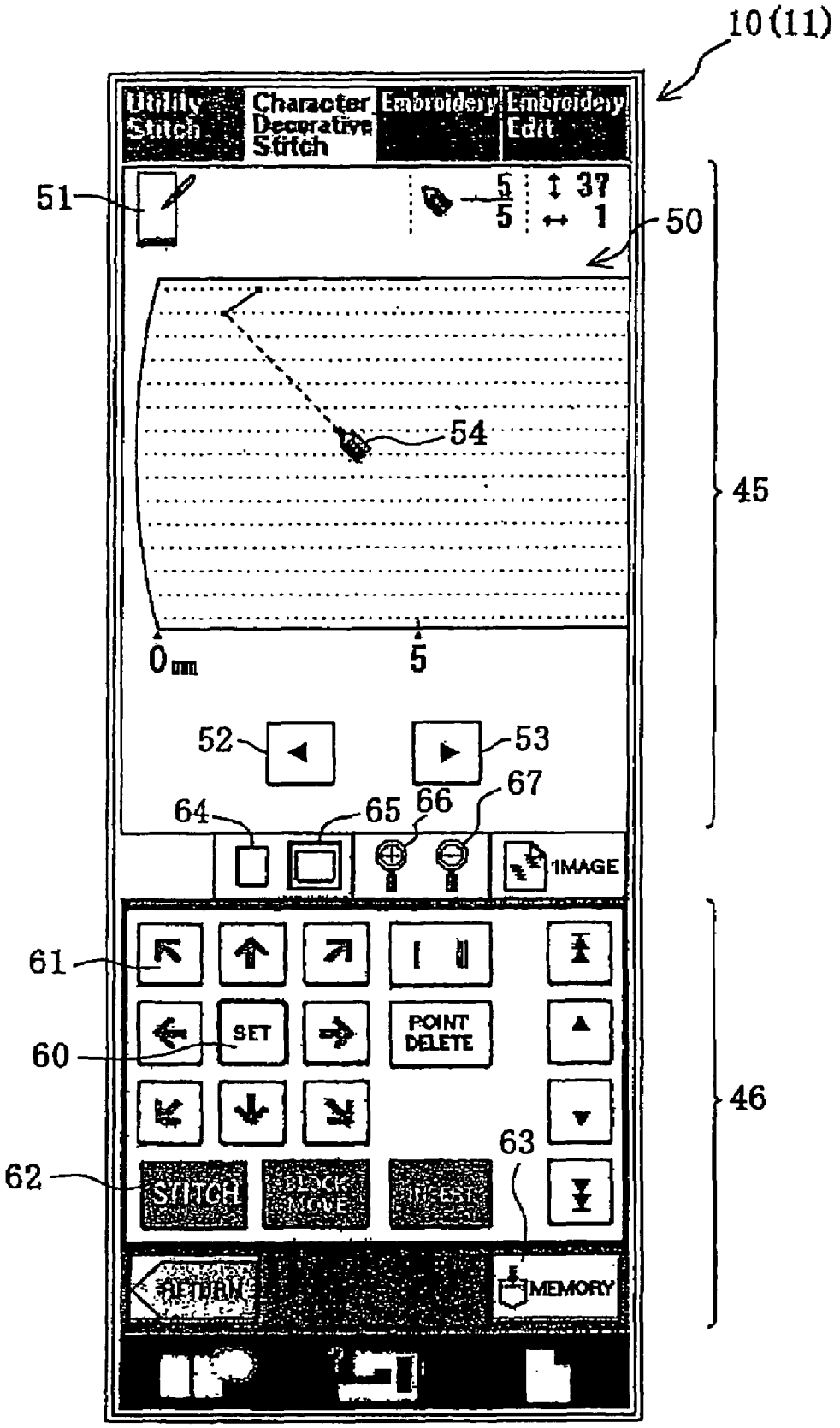
FIG. 15 illustrates a lateral campus in my-illustration producing screen.

When each of the other function keys is operated (S31: NO), a process corresponding to the operated function key is carried out (S33) although the processing is not described in detail. For example, when a sideways display key 65 is depressed with the campus 50 being displayed in the scaled-up state, the campus 50 turned sideways is displayed as shown in FIG. 15. Thus, the user can change the direction of the campus 50 so that the needle drop points can easily be input.

The touch pen 8 is used in the foregoing embodiment. However, a plurality of cursor moving keys 61 may be operated in combination so that the pencil mark 54 is moved for input of the needle drop points. Furthermore, the saving key 63 may be operated so that the produced pattern data or display data are stored on the flash memory 20.

The following effects can be achieved from the foregoing embodiment. When pattern data corresponding to a desired pattern input by the user is produced, the user can input on the touch panel 11 (the campus 50) a plurality of points corresponding to a plurality of needle drop points forming the pattern respectively while using the touch pen 8. In this case, one needle drop point can be input by every single operation of the touch pen 8. In this respect, the embodiment clearly differs from the conventional construction in which the cursor moving keys need to be operated for every input of needle drop point. Consequently, the operation for input of a plurality of needle drop points can be simplified.

Furthermore, the produced pattern data memory 19*a* is provided for storing the pattern data produced by the pattern data producing process, and the produced display data memory 19*b* is provided for storing display data produced by the display data producing process. Consequently, the produced pattern data and display data can reliably be stored. When the display data and the pattern data are read out as occasion demands, the pattern sewing can be carried out on the basis of the read-out pattern data and the pattern can be displayed on the basis of the read-out display data.

The campus 50 (pattern input area) is displayed on the display 10, and the size scales are displayed on the outer edge of the campus 50. Consequently, the user can readily confirm the size of the pattern to be input onto the campus 50 on the basis of the campus 50 and the size scales. Furthermore, since the campus 50 is scaled up and down, the pattern can be input with the size thereof being rendered suitable for the user to view. Consequently, the operability of the pattern data producing device can further be improved. Additionally, the width of the campus 50 in the needle swing direction (lateral direction) is displayed so as to correspond to a width rendering needle swing possible. Consequently, the user can readily confirm on the display 10 the width of the pattern at the needle swing side.

The holder 2*a* holding the touch pen 8 when the touch pen 8 is non-used is provided near the display 10 mounted on the pillar 2 of the sewing machine M. The lamp 9 turned on when the touch pen 8 is usable is also provided near the display 10. Consequently, the touch pen 8 can readily be kept safe, and the user can readily understand whether the touch pen 8 is usable.

Several modified forms of the foregoing embodiment will be described. Firstly, although the touch panel 11 is of the analog detection type in the foregoing embodiment, various detection types of touch panels such as a contact type by printed wiring may be used, instead.

Second, the touch lamp 9 may be flashed so that the user may be informed that the touch pen 8 can be used. Third, the holder may be mounted on the front side of the pillar 2 near the touch pen lamp 9. Fourth, the touch input mark 51 may be flashed or the message that input by the touch pen 8 can be displayed, instead of the touch pen lamp 9.

The foregoing description and drawings are merely illustrative of the principles of the disclosure and are not to be construed in a limiting sense. Various changes and modifications will become apparent to those of ordinary skill in the art. All such changes and modifications are seen to fall within the scope of the disclosure as defined by the appended claims.

What is claimed is:

1. A pattern data producing device incorporated in a sewing machine which comprises a sewing mechanism including a needle swing mechanism and a display and in which the sewing mechanism is operated so that a pattern sewing can be carried out, thereby producing pattern data, the pattern data producing device comprising:

a touch panel provided on an outer surface of the display so as to be capable of detecting a location of touch thereon;

a pen-shaped pointing device that interacts with the touch panel, the pen-shaped pointing device capable of inputting a plurality of points, which correspond to a plurality of needle drop points;

a pattern data producing unit that obtains location data of needle drop points from the points inputted by the pen-shaped pointing device to produce pattern data, upon the pen-shaped pointing device interacting with the touch panel, the pattern data producing unit automatically designates a needle drop point of the plurality of needle drop points without further operating;

a display data producing unit that produces, from the location data of needle drop points, display data for displaying a configuration of the pattern on the display; and a display control device which controls the display so that a pattern input screen is displayed on the display, wherein the display control device causes the display to display a pattern input area, wherein the display control device controls the display so that a width of the pattern input area in a needle swing direction is displayed on a reduced scale corresponding to a maximum needle swing width of the needle swing mechanism.

2. The pattern data producing device according to claim 1, wherein the touch panel comprises resistive pressure-sensitive analogue detection technology.

3. The pattern data producing device according to claim 1, further comprising a pattern data storage unit which stores the pattern data produced by the pattern data producing unit and a display data storage unit which stores the display data produced by the display data producing unit.

4. The pattern data producing device according to claim 1, wherein the display control device causes the display to display the pattern input area on the display and a dimensional scale on an outer edge of the pattern input area.

5. The pattern data producing device according to claim 1, further comprising a scale-up and scale-down instructing unit which instructs scale-up and scale-down of the pattern input area displayed on the display.

6. The pattern data producing device according to claim 1, wherein the sewing machine includes a pillar, the display is mounted on the pillar, and the pillar includes a holder holding the pen-shaped pointing device when the pen-shaped pointing device is unused and a lamp lighted or flashed when the pointing device is usable, both the holder and the lamp being located near the display.

7. A computer readable memory medium which is accessed by a computer to carry out a pattern data producing control, the computer controlling a pattern data producing device incorporated in a sewing machine which comprises a sewing mechanism including a needle swing mechanism and a display and in which the sewing mechanism is operated so that a pattern sewing can be carried out, thereby producing pattern data, the memory medium storing a program comprising:

an input data taking-in routine of taking in data of a plurality of input points input by a pen-shaped pointing device onto a touch panel provided on a surface of the display and corresponding to a plurality of needle drop points forming a pattern, wherein a needle drop point of the plurality of needle drop points is automatically designated upon touching the touch panel with the pen-shaped pointing device, without further operation;

a pattern data producing routine of obtaining location data of the needle drop points from the input points, thereby producing pattern data;

a display data producing routine of producing, from location data of the needle drop points, display data for displaying a configuration of the pattern on the display; and a display control routine of controlling the display so that a pattern input screen is displayed on the display, wherein the display control routine causes the display to display a pattern input area on the display, wherein the display control routine displays on the display a width of the pattern input area in a needle swing direction on a reduced scale corresponding to a maximum needle swing width of the needle swing mechanism.

8. The computer readable memory medium according to claim 7, wherein the display control routine causes the display to display the pattern input area on the display and a dimensional scale on an outer edge of the pattern input area.

9. The computer readable memory medium according to claim 7, wherein when an instruction to scale up or down the pattern input area to be displayed on the display is received, the display control routine scales up or down the pattern input area to be displayed on the display according to the instruction.

* * * * *